US008919126B2

(12) United States Patent
Nilsson

(10) Patent No.: US 8,919,126 B2
(45) Date of Patent: Dec. 30, 2014

(54) COOLED PILOT FUEL LANCE

(75) Inventor: Ulf Nilsson, Whetstone (GB)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/114,905

(22) PCT Filed: Apr. 23, 2012

(86) PCT No.: PCT/EP2012/057343
§ 371 (c)(1),
(2), (4) Date: Nov. 19, 2013

(87) PCT Pub. No.: WO2012/150139
PCT Pub. Date: Nov. 8, 2012

(65) Prior Publication Data

US 2014/0060071 A1 Mar. 6, 2014

(30) Foreign Application Priority Data

May 3, 2011 (EP) ..... 11164594

(51) Int. Cl.
*F02C 1/00* (2006.01)
*F23D 11/28* (2006.01)
*F23R 3/34* (2006.01)
*F23R 3/28* (2006.01)

(52) U.S. Cl.
CPC . *F23R 3/28* (2013.01); *F23D 11/28* (2013.01); *F23R 3/343* (2013.01)
USPC ..... 60/740

(58) Field of Classification Search
USPC ..... 60/740, 742, 746, 747, 734; 236/132.5; 239/132.5
See application file for complete search history.

(56) References Cited

U.S. PATENT DOCUMENTS

| | | | | |
|---|---|---|---|---|
| 2,743,137 | A * | 4/1956 | Wilson | 239/125 |
| 3,029,029 | A | 4/1962 | Webster | |
| 3,121,457 | A * | 2/1964 | Whipple et al. | 239/132.3 |
| 3,170,016 | A * | 2/1965 | Grace | 239/132.3 |
| 3,198,436 | A * | 8/1965 | Kurzinski et al. | 239/132.1 |
| 3,662,959 | A | 5/1972 | Sample, Jr. | |
| 3,831,858 | A * | 8/1974 | Casey | 239/464 |
| 3,985,301 | A * | 10/1976 | Tindall | 239/126 |
| 5,264,244 | A | 11/1993 | Edwards, III | |

(Continued)

FOREIGN PATENT DOCUMENTS

| | | | |
|---|---|---|---|
| GB | 899527 | A | 6/1962 |
| NL | 69845 | C | 4/1952 |

*Primary Examiner* — Phutthiwat Wongwian
(74) *Attorney, Agent, or Firm* — Beusse Wolter Sanks & Maire, PA

(57) ABSTRACT

A device for injecting fuel into a combustion chamber of a gas turbine is provided, having a distribution section to which a first fuel channel, a second fuel channel and an injection channel are coupled. The first fuel channel and the second fuel channel are arranged such that a) fuel is transportable by one of the first fuel channel and the second fuel channel to the distribution section, and b) a first quantity of fuel is transportable by the other one of the first fuel channel and the second fuel channel out of the distribution section. The injection channel is arranged such that a second quantity of fuel is injectable from the distribution section into the combustion chamber. The device further comprises an end cap with a protrusion having the injection channel inside, and extending inside the inner tube.

12 Claims, 4 Drawing Sheets

(56) References Cited

U.S. PATENT DOCUMENTS

| | | | | | |
|---|---|---|---|---|---|
| 5,266,360 | A | | 11/1993 | Edwards, III | |
| 5,315,822 | A | | 5/1994 | Edwards, III | |
| 5,467,925 | A | * | 11/1995 | Riano | 239/132.3 |
| 5,568,721 | A | | 10/1996 | Alary | |
| 5,577,386 | A | * | 11/1996 | Alary et al. | 60/742 |
| 5,805,973 | A | | 9/1998 | Ackerman et al. | |
| 5,833,141 | A | | 11/1998 | Bechtel, II | |
| 6,003,781 | A | * | 12/1999 | Kwan | 239/132.3 |
| 6,123,273 | A | | 9/2000 | Bechtel, II et al. | |
| 2010/0071373 | A1 | * | 3/2010 | Martin et al. | 60/734 |
| 2012/0180490 | A1 | * | 7/2012 | Takami et al. | 60/740 |

* cited by examiner

COOLED PILOT FUEL LANCE

CROSS REFERENCE TO RELATED APPLICATIONS

This application is the US National Stage of International Application No. PCT/EP2012/057343 filed Apr. 23, 2012, and claims the benefit thereof. The International Application claims the benefit of European Application No. EP 11164594.1 filed May 3, 2011. All of the applications are incorporated by reference herein in their entirety.

FIELD OF INVENTION

The present invention relates to a device for injecting fuel into a combustion chamber of a turbine, in particular a gas turbine. Moreover, the present invention relates to a method of operating a device for injecting fuel into a combustion chamber of a turbine, in particular of a gas turbine.

BACKGROUND

Turbines, and in particular gas turbines, are driven by burning fuel, for example liquid fuel, in a combustion chamber. Over time, gas turbines operating on liquid fuel, such as heating oil for example diesel fuel, tend to clog up and block its fuel nozzles through which fuel is injected into the combustion chamber. This may lead to poor start reliability and requires additional maintenance. This problem is particularly accentuated for gas turbines applying a dry low emission (DLE) burning process. In such dry low emission systems, the lowest emissions may be achieved if a high degree of atomization of the fuel in a main operating range is applied. During the start of the turbine and during low load operation of the turbine larger droplets and a less distributed fuel spray is injected into the fuel chamber due to the reduced mass flow and due to a reduced pressure of the fuel flow. This increases the tendency of the fuel splashing and smearing the nozzles, which are in particular installed in a fuel lance tip, and adjacent areas. During operation, the fuel on covered surfaces will coke and carbonize and thereby creating a hard and adhesive coating. This process is driven by the heat from the combustion process in the combustion chamber.

FIG. 3 illustrates a combustion chamber comprising a pilot burner face to which a common fuel lance 301 is attached.

Moreover, an igniter 302 is mounted to the pilot burner face. The pilot burner face is surrounded by a swirler 303 for injecting a fuel/air stream 304. Through the common fuel lance 301, fuel, in particular pilot fuel, is injected through a fuel nozzle.

FIG. 4 shows the common fuel lance 301 in more detail. The fuel is transported through a fuel channel 401 to a common injection channel 403 which is installed in a common end cap 402. For cooling purposes, the common injection channel 403 is surrounded by air inlet holes 404, through which cooling fluid is injectable. The air inlet holes 404 may also be used as a means to change the characteristics of the fuel spray as it exits the common injection channel 403.

The pilot burner face reaches temperatures of between approximately 800° C. to 1000° C. (Celsius) during operation. The air inlet holes 404 are adapted for cooling the common end cap 402 of the common fuel lance 301. Moreover, the cooling air interacts with the fuel injected from the common injection channel 403 to create an improved atomization and a better spray of fuel inside the combustion chamber. The air inlet holes 404 are potentially blocked by fuel drops after some time of operation under low loads (with a corresponding low fuel flow through the common injection channel 403). The low fuel flow through the common injection channel 403 leads to a higher temperature of the common end cap 402 of the common fuel lance 301 so that the carbonisation is intensified until the fuel flow through the common injection channel 403 stops due to a blockage of a fuel orifice (common injection channel 403) of the common fuel lance 301. In conventional designs of combustion chambers, diffusion flame principles are applied, which allows less sensitive nozzles being to be used. However, diffusion flame principles increase emissions. This can be in part mitigated by adding water or steam to the fuel or the flame zone to cool the flame.

U.S. Pat. No. 5,833,141 A discloses an anti-coking dual-fuel nozzle for a gas turbine combustor. The dual-fuel nozzle comprises a liquid fuel nozzle surrounded by an air/gas pre-mixing cup. The cup has a base which comprises swirler vanes surrounding the outer tube of the liquid fuel nozzle. The air/gas cup surrounds the liquid fuel nozzle such that channels between the liquid fuel nozzle and the air/gas pre-mixing cup are formed. In a downstream end section of the air/gas pre-mixing cup, the air/gas pre-mixing cup comprises a conical section.

U.S. Pat. No. 6,123,273 A discloses a dual-fuel nozzle for inhibiting carbon deposition onto combustor surfaces in a gas turbine. The dual-fuel nozzle comprises a liquid fuel nozzle surrounded by a gas fuel nozzle. A converging sleeve surrounds the converging outer wall of the combined liquid fuel and gaseous nozzle to form a duct of decreasing cross-sectional areas in a downstream direction, such that an airflow through the duct accelerates towards the conical droplet spray pa¬ tern emerging from the liquid fuel nozzle. The accelerated air flowing through the duct precludes an impingement of oil spray droplets onto metal surfaces of the nozzle. Furthermore, it is known that the fact of carbonization varies with the metal in contact with the hydrocarbon liquid fuel. Some materials are believed to be less reactive than others. U.S. Pat. No. 5,315,822 A, U.S. Pat. No. 5,266,360 A, U.S. Pat. No. 5,264,244 A and U.S. Pat. No. 5,805,973 disclose coatings of titanium, silicon or aluminium to be applied on the base material, which consists for example of steel or of nickel alloys. Moreover, it is known to use liquid fuel nozzles with a return flow. U.S. Pat. No. 3,029,029 discloses a dual-orifice return flow nozzle for use with a gas turbine. The dual-orifice return flow nozzle comprises a fluid inlet passage through which fuel is adapted to flow to discharge orifices. Through a primary orifice fuel may inject into the combustion chamber.

U.S. Pat. No. 3,662,959 discloses a fuel injection nozzle which comprises an elongated primary fuel passage in a nozzle housing which is constituted by a length of a tube which is thermally isolated from a housing, whereby the flow of fuel through the tube maintains the interior wall at a temperature below that at which carbonizing of the fuel would occur.

SUMMARY OF THE INVENTION

It is an objective of the present invention to provide an efficient cooling of a fuel lance for a turbine.

This objective may be solved by a device for injecting fuel into a combustion chamber of a turbine, in particular a gas turbine, and by a method of operating a device for injecting fuel into a combustion chamber of a turbine, in particular a gas turbine, according to the independent claims.

According to a first aspect of the present invention, a device (in particular a fuel lance) for injecting fuel into a combustion chamber of a turbine, in particular a gas turbine, is presented.

The device comprises a distribution section, a first fuel channel, a second fuel channel and an injection channel. The first fuel channel, the second fuel channel and the injection channel are coupled to the distribution section. The first fuel channel and the second fuel channel are arranged in such a way that (e.g. all of the) fuel is tran¬ portable, e.g. from a fuel tank, by one of the first fuel channel and the second fuel channel to the distribution section and a first quantity of fuel is transportable by the other one of the first fuel channel and the second fuel channel out of the distribution section e.g. back to the fuel tank. The injection channel is arranged in such a way that a second quantity of fuel is injectable from the distribution section into the combustion chamber. Furthermore, the device comprises a pressure control arrangement which is arranged for controlling a pressure of the fuel in at least one of the first fuel channel and the second fuel channel such that the first quantity and the second quantity is controllable.

The device comprises an inner tube and an outer tube which surrounds the inner tube. The inner tube and the outer tube are arranged coaxial with respect to each other. Between an inner surface of the outer tube and an outer surface of the inner tube is a space—an annular passage—for forming the first or second fuel channels. For example, the first fuel channel is formed by the space and the second fuel channel is formed by the inner tube—the inner tube defining preferably a cylindrical passage. In an alternative example, the second fuel channel is formed by the space and the first fuel channel is formed by the inner tube. The device further comprises an end cap into which the injection channel is formed. The end cap is mounted to an open end of the outer tube. The distribution section may be formed between the end cap, the open end of the outer tube and an open end of the inner tube. If the device according to the present invention is installed in the pilot burner, the end section of the device is the part of the device which faces the interior of the combustion chamber and is thus in exposed to the burner flame inside the combustion chamber. The end cap is the part of the device which is closest to the interior of the combustion chamber. Hence, the end cap may be the part of the device which is at most exposed to the hot temperatures of the burned fuel or burning fuel air mixture. The end cap comprises a protrusion which extends inside the inner tube in such a way that a part of the first fuel channel is formed between an inner surface of the inner tube and an outer surface of the protrusion. Hence, the length of the flow path of the fuel inside the first fuel channel through the end cap is increased, such that the fuel may absorb more thermal energy respectively more heat from the material of the end cap.

The injection channel is formed inside the protrusion. Hence, if the protrusion is surrounded by the first fuel channel and thus cooled by the fuel, the risk of clogging of the injection channel is reduced due to the reduced temperature of the injection channel.

According to a further aspect of the present invention, a turbine, in particular a gas turbine, is presented. The turbine comprises a device as described above and a pilot burner, wherein the device is arranged into the pilot burner for injecting fuel into the combustion chamber.

According to a further aspect of the present invention, a method of operating a device as described above for injecting fuel into a combustion chamber of a turbine, in particular a gas turbine, is presented. According to the method, fuel is transported by one of a first fuel channel and a second fuel channel to a distribution section. A first quantity of fuel is transported by the other one of the first fuel channel and the second fuel channel out of the distribution section. A second quantity of fuel is injected from the distribution section through an injection channel into the combustion chamber. The first quantity and the second quantity are controlled by controlling a pressure of the fuel in at least one of the first fuel channel and the second channel. According to an exemplary embodiment of the present invention, the first fuel channel and the second fuel channel are arranged in such a way that the fuel is transportable by the first fuel channel to the distribution section and the first quantity of fuel is transportable by the second fuel channel out of the distribution section.

The combustion chamber is generally formed in a tubular-like shape comprising a centre axis. Along the centre axis the combustion chamber may comprise a pre-chamber and a main chamber, which has generally a larger diameter than the pre-chamber. The pre-chamber is defined by a shell surface extending generally in an axial direction, downstream of a swirler, with respect to the centre axis. One open end of the pre-chamber is closed by the pilot burner. The device for injecting the fuel into the combustion chamber, in particular the pilot fuel lance, is adapted for injecting fuel along a generally parallel direction with respect to the centre axis of the combustion chamber.

A pressure inside the first fuel channel and the second fuel channel is controllable. The first fuel channel and the second fuel channel generate a fuel circulation, e.g. from a fuel tank to the distribution section and again out of the distribution section to the fuel tank. By controlling the pressure of the fuel in at least one of the first fuel channel and the second fuel channel, the volume flow and the flow speed of the fuel in the recirculation generated by the first fuel channel and the second fuel channel is controllable.

The injection channel is coupled to the distribution section. Hence, by controlling with the pressure control arrangement the pressure in the first fuel channel and the second fuel channel, the first quantity of fuel, which is transportable from the distribution section back out of the device, e.g. to the fuel tank, and simultaneously the second quantity of the fuel which is injected through the injection channel from the distribution section into the combustion chamber is controllable.

By the present invention, a pressure control arrangement is adapted for controlling a recirculation, in particular a first quantity of fuel within the recirculation between a first and a second fuel channel, and a second quantity of fuel which is injected into the combustion chamber. Because the pressure control arrangement is adapted for controlling a pressure in the first fuel channel and the second fuel channel, a distributing device, such as a distributing valve, installed for example inside the distribution section, is not required. The distribution section defines a volume into which the fuel is injected by the first channel and is bleed off to the second channel and the injection channel. In particular, the distribution section is formed in a tip end of the device. A tip end of the device is formed close to the pilot burner face of the pilot burner which faces the inside of the combustion chamber. Hence, the temperatures close to the distribution section are very high. This high temperature would wear and carbonize the channels through which fuel flows. Hence, by the present invention, more fuel than required for operating the turbine is circulating inside the device, particularly at low load or load conditions, where a low pilot fuel flow is required to operate the gas turbine, so that the fuel functions as a coolant agent. The first quantity and the second quantity are simply controlled by a respective pressure in the first fuel channel and/or the second fuel channel without any movable controlling parts installed close to the tip end of the device. Hence, the life of the device is increased and the maintenance costs are reduced.

In other words, the device, i.e. the pilot fuel lance, functions as a heat exchanger driven by a recirculation of the fuel as a cooling agent. By the high liquid fuel flow in the circulation also at low loads, or operating conditions were a low pilot fuel flow is normally used for the gas turbine the liquid fuel functions as a heat absorbing media, so that the temperature of the tip end of the device is reduced and may be kept under control so that carbonization and blockage of the pilot fuel lance is reduced. Thus, extra maintenance and down time is reduced. The capacity of a fuel pump which pumps the fuel into the device does not need to be amended because the maximum design flow data may be kept unchanged by using the device according to the present invention.

According to a further exemplary embodiment, the turbine or particularly the pressure control arrangement further comprises the fuel pump to which the respective first fluid channel or second fluid channel, through which the fuel is transportable forward to the distribution section, is coupled. By the fuel pump, the pressure and thus the fuel flow of the forward flow to the distribution section is controllable.

According to a further exemplary embodiment, the pressure control arrangement comprises a first pressure control device, in particular a first valve. The first pressure control device is coupled to the first fuel channel for controlling a first pressure of the fuel in the first fuel channel.

According to a further exemplary embodiment, the pressure control arrangement comprises a second pressure control device, in particular a second valve. The second pressure control device is coupled to the second fuel channel for controlling a second pressure of the fuel in the second fuel channel. According to a further exemplary embodiment, the first or the second pressure control device comprises a fluidic valve, which is fluidically controlled. The fluidic valve comprises a control conduit through which a control fluid flows and a main conduit through which the first quantity of fuel flows backward out of the distribution section e.g. to the fuel tank. The control fluid controls a flow rate and a pressure of the fuel flowing out of the distribution section through the main conduit and thus through the respective fuel channel. The control fluid flows through the control conduit and is injected partially against the flow direction of the fuel flowing through the main conduit. If the control pressure of the control fluid is much higher than the pressure of the first portion of the fuel, the fluidic valve is closed and the flow of fuel through the main conduit is reduced. Hence, depending on the control pressure of the control fluid the fuel flow through the main conduit is controlled. Moreover, the control conduit is further coupled to the first or second channel, where the fuel flows forward to the distribution section, such that the control fluid is taken from the respective fuel channel in which the forward fuel flow to the distribution section flows. Hence, the control fluid is a fraction (third quantity) of the forward flowing fuel which flows to the distribution section, such that the control fluid comprises similar parameter values, i.e. pressure values, as the fuel flowing forward to the distribution section. Hence, the fluidic valve is controllable by the pressure and flow rate of the flow flowing to the distribution section.

Hence, a gradual control of the fuel flow in both first and second fluid channels is achieved. A gradual control of both first and second valves simultaneously is not needed across the entire fuel flow range. In case having one fluidic valve both fuel streams (forward fuel stream and backward fuel stream) may be controlled simultaneously, because dependent of the pressure and flow rate of the control fluid, which is a fraction of the forward fuel stream and thus comprises e.g. the pressure of the forward fuel stream, the pressure and flow rate of the backward fuel stream is controlled. Hence, both streams are effectively controlled which is a simplification. Particularly, because the fluidic valve controls the main flow of the fuel through the main conduit by injecting the control fluid from the control channel, any moving parts are obsolete and are not required. The fluidic valve is a valve which can be switched e.g. on/off with a small amount of control flow of the control fluid, which may be of higher pressure than the fuel flowing out of the distribution section through the main conduit. Moreover, the internal fluid dynamics of the fluidic valve itself determines the operative state of the fluidic valve (e.g. on/off). An exemplary embodiment of an above described fluidic valve is disclosed in EP 2 146 057 A1. Hence, by the pressure control arrangement, a desired volume flow through the first fuel channel and the second fuel channel is controllable. In particular, the respective first and second pressure control devices may control the fuel flow and the fuel pressure inside the first fuel channel and the second fuel channel individually and independent from each other. The first quantity of fuel which is flowing back from the distribution section through e.g. the second fuel channel out of the device, e.g. to the fuel tank, and the second quantity, which is injected from the distribution section through the injection channel inside the combustion chamber are controllable by adjusting the pressure in the first fuel channel and/or the second fuel channel by the respective pressure control device. For example, if the pressure of the fuel in the first fuel channel, through which the fuel is flowing e.g. to the distribution section, is high and the pressure of the second fuel channel, through which the fuel flows e.g. out of the distribution section, is low, a high flow rate/velocity of the fuel in the circulation inside the first fuel channel and the second fuel channel is achieved. If the pressure difference between the fuel in the first fuel channel and the second fuel channel is reduced, the second quantity of fuel, which is injected from the distribution section to the injection channel, is increased. For example, if the first pressure in the first fuel channel and the second pressure in the second fuel channel are close, all or nearly all of fuel is injectable from the distribution section through the injection channel into the combustion chamber.

According to a further exemplary embodiment, the inner tube comprises a main section with a constant wall thickness and a section with a further wall thickness which differs in comparison to the wall thickness of the main section, such that a flow cross-section of the first fuel channel and/or the second flow cross section of the second fuel channel differs along the section with the further wall thickness in comparison to the main section. Hence, by varying the wall thickness of the inner tube, a flow cross-section of the first fuel channel and a flow cross-section the second fuel channel may be amended. For example, if the wall thickness in the section of the inner tube reduces a respective flow cross-section of one of the fuel channels, a converging section may be generated for increasing the flow velocity of the fuel in the respective fuel channel.

The injection channel may be formed through the end cap from the distribution section to the inside of the combustion chamber. The injection channel may comprise a cylindrical shape or may comprise a nozzle-like, converging shape for generating a proper atomization of the injected fuel or for increasing the flow velocity of the fuel through the injection channel.

The end cap may be monolithically and integrally formed with the outer and/or the inner tube or may be detachably coupled to the outer and/or inner tube. Hence, by detachably coupling the end cap to the inner and/or outer tube, the end cap may be detached in a fast way, for example if the injection channel is clogged with carbonized fuel.

Moreover, the end cap may be made of a titanium alloy, preferably ASTM Grade 5 (ASTM: American Society for Testing and Materials) and even more, preferably ASTM Grade 6. The end cap may be machined by using conventional methods such as electrical discharge machining or laser welding.

According to a further exemplary embodiment, the injection channel is formed in the end cap in such a way that the injection channel is orientated coaxially with the inner tube.

According to a further exemplary embodiment, the inner tube comprises an end section which extends into the end cap in such a way that a part of the first fuel channel is formed between the outer surface of the inner tube and a further inner surface of the end cap. Hence, by the present exemplary embodiment, the recirculating fuel flow may be guided inside the end cap, such that fuel contacts the material of the end cap and hence the cooling efficiency of the fuel may be increased such that also the sections of the end cap which are close to the interior of the combustion chamber may be cooled by the fuel channel. According to a further exemplary embodiment, at least one of the first fuel channel, the second fuel channel and the injection channel comprises a section with turbulence enhancing fins. Hence, the turbulence enhancing fins may generate turbulences such that the fuel is energized in the respective channel for cooling purposes. Hence, the cooling efficiency may be increased by installing the turbulators. At the same time the temperature segmentation in the fuel after heat pick up may be reduced.

According to a further exemplary embodiment, the turbine further comprises a fuel tank to which the first fuel channel and/or the second fuel channel is coupled.

According to a further aspect of the method, the step of the controlling the first quantity and the second quantity comprises a controlling of a volume flow of the fuel through the injection channel, the first fuel channel and the second fuel channel by a) controlling a first pressure of the fuel in the first fuel channel by a first pressure control device, and/or by b) controlling a second pressure of the fuel in the second fuel channel by a first pressure control device.

The first valve and the second valve control the pressure of a respective first and second fuel channel of the device, in particular of the pilot fuel lance. Moreover, a turbine may comprise a plurality of above-described devices (pilot fuel lances), wherein one common first valve and/or one common second valve controls the respective pressures in the respective fuel channels of each of the respective devices of the turbine. For example, the first valve may act on a forward flow such that the forward flow of fuel from the fuel tank to the distribution section is controlled. The second valve may act on the backward flow of the fuel, which is lead back from the distribution section out of the device, e.g. to the fuel tank. The combined control of the first valve and the second valve controls the second quantity which is injected into the gas turbine through the injection channel. If a high fuel flow and hence a high second quantity is required to operate the gas turbine, the second valve, which acts on the backward flow, is closed, such that larger portion of or all of the fuel entering the device is injected into the combustion chamber. In case a low fuel flow is required from the device to the combustion chamber, the second valve, which acts on the backward flow from the distribution section to the gas tank, is partially or fully opened allowing a high fuel velocity in the recirculation between the first and second fuel channel so that larger portion of the fuel act as a coolant for the device and in particular the end cap, before returning to the fuel tank. Hence, the device is cooled.

It has to be noted that embodiments of the invention have been described with reference to different subject matters. In particular, some embodiments have been described with reference to apparatus type claims whereas other embodiments have been described with reference to method type claims. However, a person skilled in the art will gather from the above and the following description that, unless other notified, in addition to any combination of features belonging to one type of subject matter also any combination between features relating to different subject matters, in particular between features of the apparatus type claims and features of the method type claims is considered as to be disclosed with this application.

BRIEF DESCRIPTION OF THE DRAWINGS

The aspects defined above and further aspects of the present invention are apparent from the examples of embodiment to be described hereinafter and are explained with reference to the examples of embodiment. The invention will be described in more detail hereinafter with reference to examples of embodiment but to which the invention is not limited.

DETAILED DESCRIPTION

Figure 1:
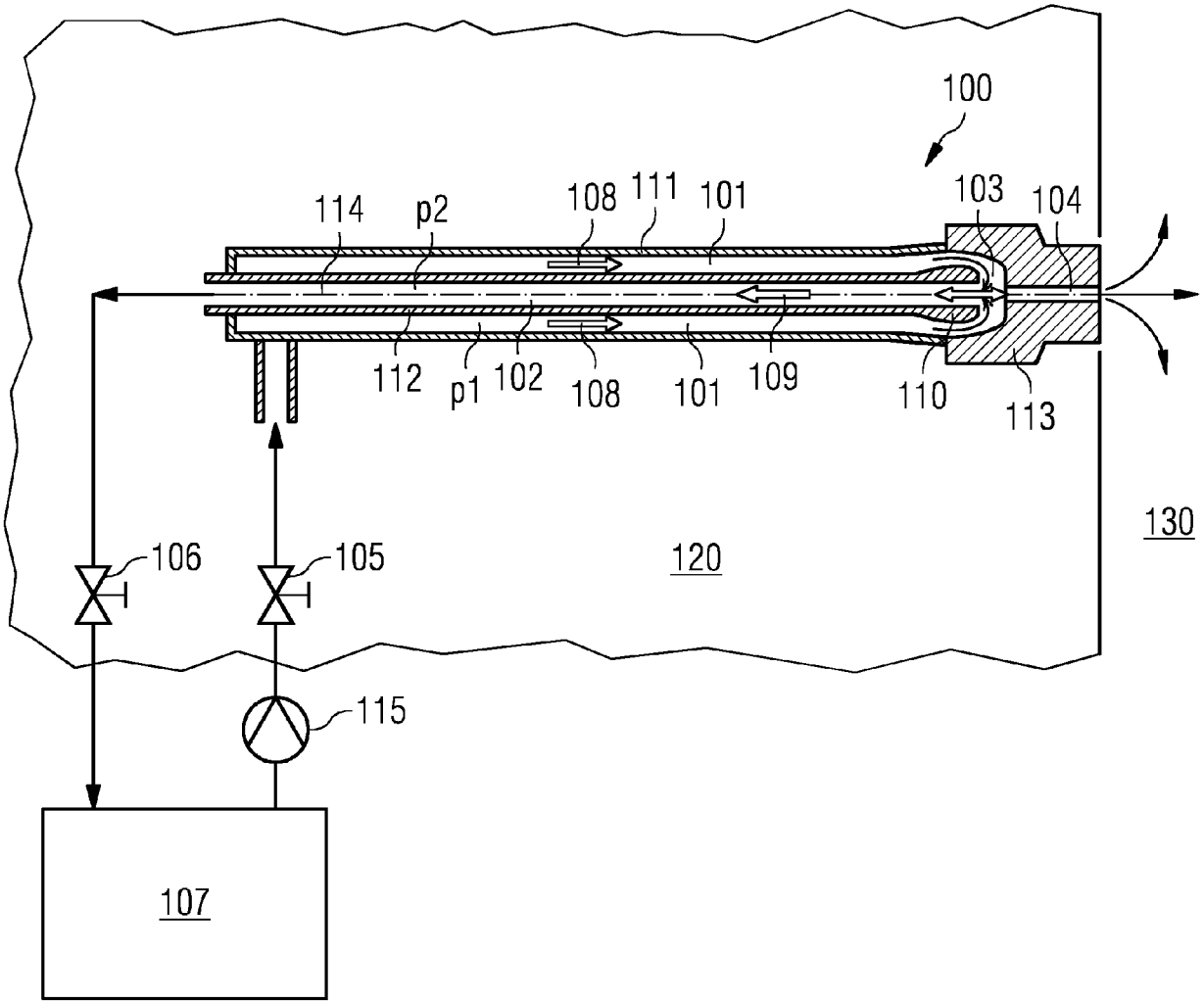
FIG. 1 illustrates a schematical view of a device according to an exemplary embodiment of the present invention.

The illustrations in the drawings are schematical. It is noted that in different figures, similar or identical elements are provided with the same reference signs.

FIG. 1 shows a device 100 for injecting fuel into a combustion chamber 130 of a turbine, in particular a gas turbine. The device 100 is installed into a pilot burner 120 such that fuel is injectable from the device 100 into the combustion chamber 130.

The device 100 comprises a distribution section 103 to which a first fuel channel 101, a second fuel channel 102 and an injection channel 104 are coupled in such a manner that fuel is flowable into or out of the distribution section 103.

As shown in FIG. 1, through the first fuel channel 101, a forward flow 108 of the fuel flows to the distribution section 103. From the distribution section 103 a backward flow 109 of fuel from the distribution section 103 out of the device 100 flows. In particular, a first quantity of the fuel is transported by the second fuel channel 102 from the distribution section 103 out of the device 100 e.g. to a fuel tank 107. The injection channel 104 is arranged in such a way that a second quantity of fuel is injectable from the distribution section 103 into the combustion chamber 130.

A pressure control arrangement is arranged in such a way that a pressure of the fuel in at least one of the first fuel channel 101 and the second fuel channel 102 is controlled. Hence, the first quantity and the second quantity are adjustable by controlling the pressure in the respective fuel channel 101, 102.

The pressure control arrangement may comprise a first valve 105 which is coupled to the first fuel channel and/or a second valve 106 which is coupled to the second fuel channel 102. The first valve 105 and the second valve 106 are adapted for controlling a first pressure pi of the fuel in the first fuel channel 101 and a second pressure p2 of the fuel in the second fuel channel 102, respectively. Moreover, a fuel pump 115 may be coupled to the first fuel channel 101 or the second fuel channel 102. The fuel pump 115 is controllable such that the pressure and the fuel flow through the respective fuel channel 101, 102 are controllable.

As shown in FIG. 1, the second fuel channel 102 is formed inside an inner tube 112 and the first fuel channel 101 is formed in a space between the inner tube 112 and an outer tube 111. In particular, the inner tube 112 and the outer tube 111 are arranged coaxial with respect to each other.

At an open end of the outer tube 111 an end cap 113 is attached. The end cap 113 may be detachably attached or permanently fixed to the outer tube 111. The injection channel 104 is formed in the end cap 113. In the exemplary embodiments as shown in FIG. 1, the injection channel 104 is formed in the end cap 113 in such a way that the injection channel 104 is oriented coaxially with the inner tube 111. In FIG. 1, a common symmetry line 114 is shown, wherein the inner tube 112, the outer tube 111 and the injection channel 104 inside the end cap 113 may share the common symmetry line 114. The distribution section 103 is formed between the open end of the outer tube 111 and the end cap 113.

The end cap 113 comprises a surface facing the interior of the combustion chamber 130, which surface runs within the plane defined by the pilot burner face of the pilot burner 120, wherein the pilot burner face is in contact with the interior of the combustion chamber 130. As shown in FIG. 1, the inner tube 112 comprises an end section 110 which extends inside the end cap 113, such that a part of the first fuel channel 101 is formed between the outer surface of the inner tube 112 and a further inner surface of the end cap 113.

Moreover, the end section 110 of the inner tube 112 may comprise a flaring. In particular, the flaring is formed by a differing wall thickness of the inner tube 112 in comparison to a wall thickness of the main section of the inner tube 112, which main section runs in particular not inside the end cap 113 but inside the outer tube 111. As shown in FIG. 1, the flaring in the section with the differing wall thickness at the end section 110 leads to a varying flow cross-section of the first fuel channel 101 between the outer surface of the inner tube 112 and the further inner surface of the end cap 113. Hence, a converging effect is generated and the flow velocity of the fuel through the first fuel channel 101 may be accelerated. Hence, by the device 100 shown in FIG. 1, a forward flow 108 of the fuel may be guided through the first fuel channel 101 to the distribution section 103. In an exemplary embodiment, the fuel flow through the injection channel 104 has an opposite direction with respect to the backward flow 109 of the fuel through the second fuel channel 102. If the pressure difference between the first pressure pi and the second pressure p2 is reduced, a higher amount of fuel and in particular more of the second quantity of fuel is injected through the injection channel 104 inside the combustion chamber 130.

If the pressure difference between the first pressure pi and the second pressure p2 is increased, the recirculation velocity of the fuel between the forward flow 108 inside the first fuel channel 101 and the backward flow 109 inside the second fuel channel 102 is increased as well so that the first quantity of the fuel which is transported out of the distribution section 103 through the second fuel channel 102 is increased. Hence, a lower amount of the second quantity of fuel is injected through the injection channel 104 into the combustion chamber 130.

The first valve 105 and the second valve 106 may be adapted for controlling one device 100 as described above. In an exemplary embodiment, a turbine may comprise a plurality of devices 100, wherein the first valve 105 and the second valve 106 may be adapted for controlling respective first and second pressures in each of the plurality of the devices 100.

Figure 2:
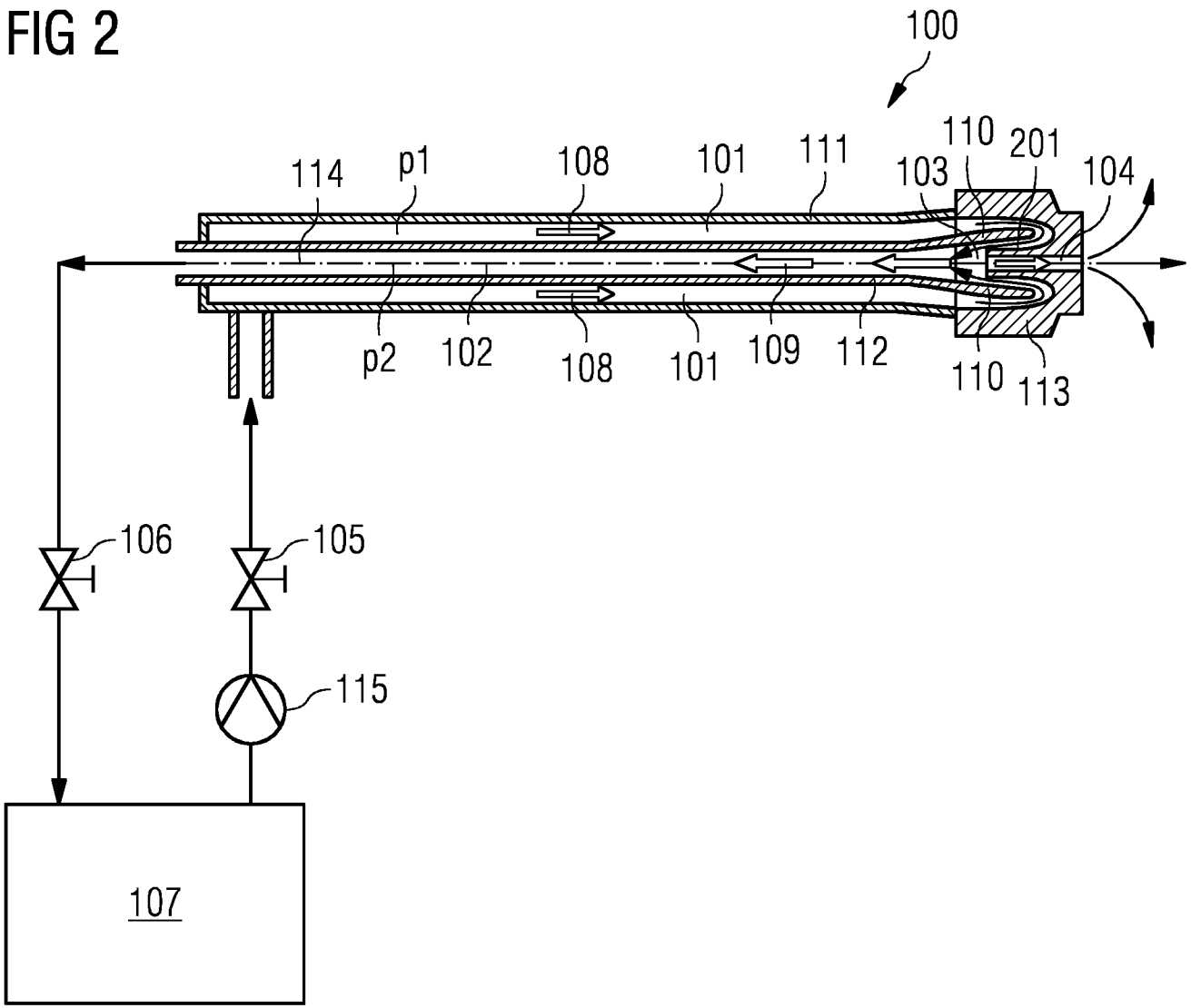
FIG. 2 illustrates a schematical view of the device comprising an end cap with a protrusion according to an exemplary embodiment of the present invention.
Figure 3:
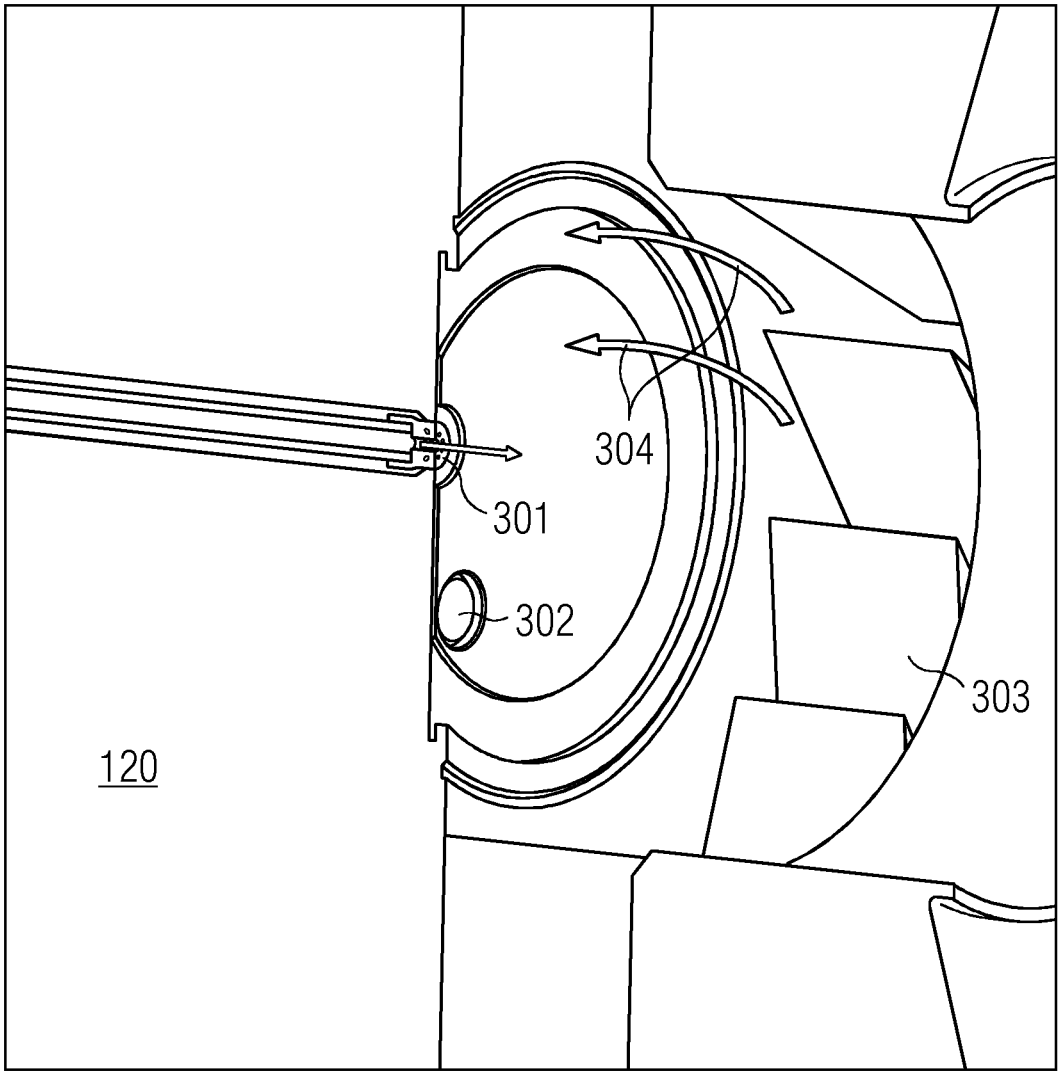
FIG 3 PRIOR ART
FIG. 3 and FIG. 4 illustrate a conventional fuel lance installed in a pilot burner.
Figure 4:
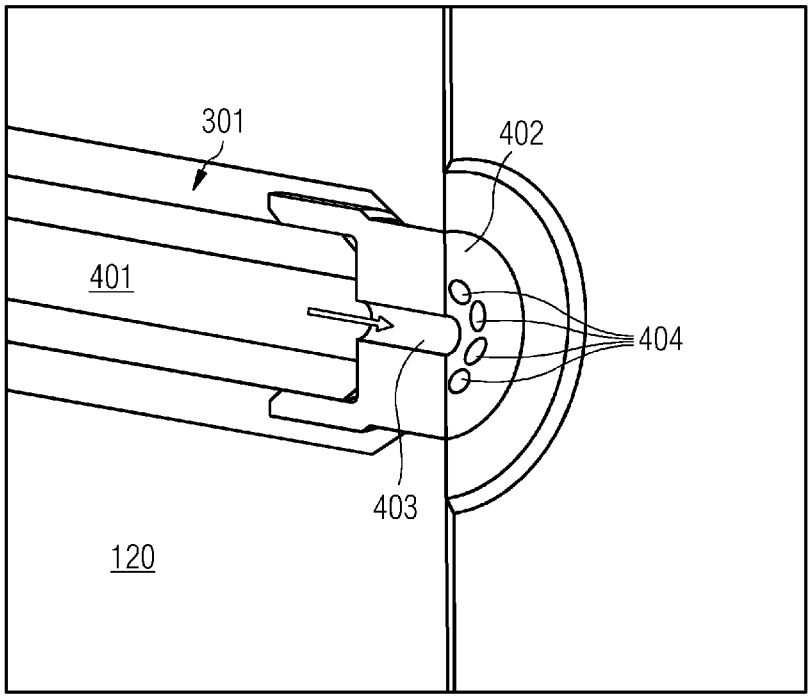
FIG 4 PRIOR ART

FIG. 2 illustrates an exemplary embodiment of the device 100 according to the present invention, wherein a protrusion 201 is formed in the end cap 113. The device 100 comprises similar features as the device shown in FIG. 1.

FIG. 2 shows additionally that the end cap 113 may comprise a protrusion 201 which extends inside the inner tube 112 in such a way that a part of the first fuel channel 101, which directs the fluid along the forward flow 108 to the distribution section 103, is formed between the inner surface of the inner tube 112 and an outer surface of the protrusion 201. In particular, the protrusion 201 extends along the common symmetry line 114 inside the inner tube 112. Hence, the forward flow 108 of the fuel inside the first fuel channel 101 has to run along a U-shape inside the end cap 113 before entering the distribution section 103. Hence, the fuel flowing along the forward flow 108 comprises a larger contact area with the end cap 113 before entering the distribution section 103. Hence, the temperature exchange between the hot material of the end cap 113 and the fuel flowing along the forward flow 108 is improved. Moreover, as shown in FIG. 2, the inner tube 112 may have a diverging shape, such that the diameter of the inner tube 112 in the end section 110 is larger than the diameter of the main section of the second turbine 112.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

The invention claimed is:

1. A device for injecting fuel into a combustion chamber of a turbine, comprising a distribution section, a first fuel channel which is coupled to the distribution section, a second fuel channel which is coupled to the distribution section, an injection channel which is coupled to the distribution section, wherein:

a) one of the first fuel channel and the second fuel channel is configured to transport fuel to the distribution section, and b) an other one of the first fuel channel and the second fuel channel is configured to transport a first quantity of fuel out of the distribution section, and c) the injection channel is configured to inject a second quantity of fuel from the distribution section into the combustion chamber, an inner tube comprising an inner surface that forms the second fuel channel, an outer tube which surrounds the inner tube, wherein the inner tube and the outer tube are arranged coaxial with respect to each other, wherein a space is formed between an inner surface of the outer tube and an outer surface of the inner tube for forming the first fuel channel, and an end cap mounted to an open end of the outer tube, wherein the end cap comprises a protrusion that extends inside the inner tube, wherein the inner surface of the inner tube and an outer surface of the protrusion are set apart from each other and define part of the first fuel channel, and wherein the injection channel is formed through the protrusion.

2. The device according to claim 1, wherein the inner tube comprises a main section with a constant wall thickness, and wherein the inner tube comprises a section with a further wall thickness, which differs in comparison to the wall thickness of the main section such that a flow cross-section of the first fuel channel and/or the second fuel channel differs along the section with the further wall thickness in comparison to the main section.

3. The device according to claim 2, wherein the injection channel is formed in the end cap in such a way that the injection channel is oriented coaxially with the inner tube.

4. The device according to claim 1, wherein the inner tube comprises an end section which extends into the end cap in such a way that a part of the first fuel channel is formed between the outer surface of the inner tube and a further inner surface of the end cap.

5. The device according to claim 1, wherein at least one of the first fuel channel, the second fuel channel and the injection channel comprises a section with turbulence enhancing features.

6. The device according to claim 1, wherein the first fuel channel and the second fuel channel are arranged in such a way that a) the fuel is transportable by the first fuel channel to the distribution section, and b) the first quantity of fuel is transportable by the second fuel channel out of the distribution section.

7. A turbine comprising a device as set forth in claim 1, and a pilot burner, wherein the device is arranged into the pilot burner for injecting the fuel into the combustion chamber of the turbine.

8. A method, comprising:

injecting the fuel into the combustion chamber of the turbine using the device according to claim 1;

transporting the fuel by the one of a first fuel channel and a second fuel channel to the distribution section, transporting the first quantity of the fuel by the other one of the first fuel channel and the second fuel channel out of the distribution section, injecting the second quantity of the fuel from the distribution section through the injection channel into the combustion chamber, and controlling the first quantity and the second quantity by controlling a pressure of the fuel in at least one of the first fuel channel and the second channel.

9. The method according to claim 8, wherein the step of controlling the first quantity and the second quantity comprises controlling a volume flow of the fuel through the injection channel, the first fuel channel and the second fuel channel by a) controlling a first pressure of the fuel in the first fuel channel by a first pressure control device, and/or by b) controlling a second pressure of the fuel in the second fuel channel by a first pressure control device.

10. The device according to claim 1, further comprising:

a pressure control arrangement which is arranged for controlling a pressure of the fuel in at least one of the first fuel channel and the second channel such that the first quantity and the second quantity is controllable.

11. The device according to claim 10, wherein the pressure control arrangement comprises a first pressure control device, wherein the first pressure control device is coupled to the first fuel channel for controlling a first pressure of the fuel in the first fuel channel.

12. The device according to claim 10, wherein the pressure control arrangement comprises a second pressure control device, wherein the second pressure control device is coupled to the second fuel channel for controlling a second pressure of the fuel in the second fuel channel.

* * * * *